US007913610B2

(12) United States Patent
Ulveraker et al.

(10) Patent No.: US 7,913,610 B2
(45) Date of Patent: Mar. 29, 2011

(54) AMMUNITION RETAINER FOR LINKED AMMUNITION

(75) Inventors: Vidar Ulveraker, Kongsberg (NO); Nils Lokken, Kongsberg (NO); Benny A. Stenmo, Kongsberg (NO)

(73) Assignee: Kongsberg Defence & Aerospace, Kongsberg (NO)

( * ) Notice: Subject to any disclaimer, the term of this patent is extended or adjusted under 35 U.S.C. 154(b) by 0 days.

(21) Appl. No.: 12/175,845

(22) Filed: Jul. 18, 2008

(65) Prior Publication Data

US 2010/0011946 A1 Jan. 21, 2010

(51) Int. Cl.
*F41A 9/79* (2006.01)
*F42B 39/00* (2006.01)

(52) U.S. Cl. ..... 89/33.14; 89/34

(58) Field of Classification Search ..... 89/33.1, 89/33.14, 33.2, 33.5, 34; 206/3
See application file for complete search history.

(56) References Cited

U.S. PATENT DOCUMENTS 2,452,545 A * 11/1948 Broga ..... 89/34
2,459,934 A * 1/1949 Haberlin ..... 89/34
2,710,561 A * 6/1955 Dowd ..... 89/34
2,811,084 A 10/1957 Cook et al.
2,874,615 A 2/1959 Kravik
3,461,774 A * 8/1969 Maurer et al. ..... 89/34
3,580,131 A 5/1971 Zimmerman
3,974,738 A * 8/1976 Meyer ..... 89/34
4,009,638 A 3/1977 Ramseyer et al.
4,213,376 A 7/1980 Jackson
4,393,746 A 7/1983 Rocha
4,433,609 A 2/1984 Darnall
4,610,191 A 9/1986 Schmid et al.
4,724,739 A * 2/1988 Heberlein ..... 89/33.2
4,882,972 A * 11/1989 Raymond ..... 89/34
4,972,758 A 11/1990 Austin et al.
4,974,490 A 12/1990 Austin
5,614,689 A * 3/1997 Gyre et al. ..... 89/33.04
6,164,180 A 12/2000 Sulm et al.

* cited by examiner

*Primary Examiner* — Bret Hayes
(74) *Attorney, Agent, or Firm* — Young & Thompson

(57) ABSTRACT

An ammunition retainer apparatus for restraining a continuous belt of linked ammunition cartridges loaded into bays of an ammunition box or magazine from flowing over a divider wall from a first bay to a second bay adjacent to the first bay. The ammunition retainer apparatus comprises an elongated body having on a first side, a first pair of tabs rigidly attached to the body and protruding from the body in a first direction, and on a second side, a second pair of tabs rigidly attached to the body and protruding from the body in a second direction.

6 Claims, 6 Drawing Sheets

AMMUNITION RETAINER FOR LINKED AMMUNITION

TECHNICAL FIELD

Figure 1:
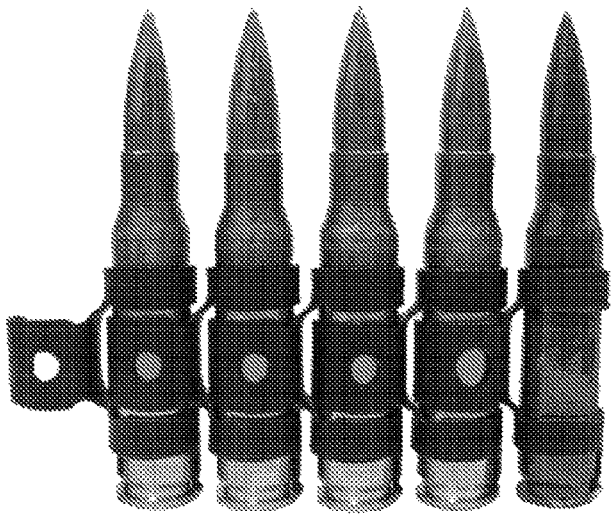

The invention relates to an apparatus for keeping linked ammunitions deposited in a box or magazine with bays separated by divider walls from flowing from one bay to another to reduce or avoid the risk of possible entangling or jamming of the ammunition.

BACKGROUND OF THE INVENTION

Ammunition boxes are used to store large quantities of ammunition to supply machine guns and other firearms with ammunition. The ammunition is usually individual bullets that are joined together with links forming a continuous belt of ammunition and then folded into ammunition boxes from where the linked ammunition is fed to the weapon.

A conventional ammunition box is most often box-shaped where the width is narrow compared to the length and height. The ammunition box may also be divided into several smaller chambers or bays by divider walls, the divider walls herein referred to as partitions or baffles, where each chamber stores a certain amount of the total linked ammunition. The width of the ammunition box or chambers is wide enough to receive the width of the linked ammunition. In this patent application it is referred to ammunition boxes with divider walls, baffles or partitions, and chambers or bays.

When pulling linked ammunition out of a horizontally leveled and/or stationary ammunition box during firing the conventional ammunition boxes usually work as intended. But once the ammunition box is tilted or exposed to vibration, which are two common scenarios when mounted on a moving vehicle, unless a means for retaining the ammunition in the box where it was placed on filling of the box, the linked ammunition starts to move from one chamber to another within the ammunition box causing interlocking and jamming of ammunition and subsequent loss of weapons fire. The reason for the interlocking and jamming is the non-symmetric design of the bullets. The bullets have a pointed projectile end and a wider powder cartridge base. When the linked ammunition starts to move from one chamber to another within the ammunition box the pointed projectile end has a tendency to get entangled between the bullets in the linked ammunition belt that is being fed to the weapon or fall down on top of the other ammunition already in the chamber in such a way that it causes interlocking and jamming.

This problem is especially apparent when the ammunition box is tilted causing a negative or positive pitch. During pitch the linked ammunition has a tendency to fall towards the lowest point in the ammunition box due to gravity, thereby falling from one chamber to another which can cause the already mentioned interlocking and ammunition jamming. Another problem is the siphon effect that will occur when one chamber is emptied during firing and the level of linked ammunition gets below the neighboring chamber's level. When this occurs the linked ammunition will start to move from one chamber to the next due to the siphon effect which causes interlocking and ammunition jamming, unless a means for retaining the ammunition in the box in such a way as to preventing the siphon effect to occur. The siphon effect problem is also present on horizontally leveled and/or stationary ammunition boxes.

The main goal of the invention has been to stop the undesired effect of linked ammunition moving from one chamber to another within the ammunition box and keep it in place like it was originally loaded into an ammunition box which does not include a means for retaining the ammunition in the box to prevent it from moving from one chamber to another.

European patent EP0430565B1 discloses a magazine for storing a belt of ammunition, the magazine comprising a box like container having a plurality of spaced partitions to subdivide the interior of the container into bays, each partition having an upper edge, and an anti-siphon member supported on the upper edge of each of the spaced partitions. Each anti-siphon member is supported on said upper edge of its respective partition for limited pivotal movement. Each member has an integral projecting finger movable between retracted and extended positions relative to the peripheral surface of rollers mounted in positions above the edges. Upon withdrawal of an ammunition belt loaded in the container with multiply folded serpentine portions thereof deposited in each bay and with interconnecting loop portions thereof draped over the rollers from one bay to an adjacent bay, the fingers assume the retracted positions to permit movement of the belt out of the bays directly to an exit port of the container and assume the extended positions engaging the interconnecting loop portions of the ammunition belt to prevent syphoning movements thereof into the bays as the serpentine belt portions are being withdrawn therefrom to the exit port.

U.S. Pat. No. 2,710,561 discloses in an ammunition box having partitions forming a series of open compartments wherein a cartridge belt may be stored by looping the belt into the compartments over the partitions, a pawl connected to an upper end of the partition for preventing retrograde movement of the belt with respect to the compartment. The pawl is pivotally connected to the partition so as to allow limited pivotal movement of the pawl from a rearwardly projected position to a generally in-line position with respect to the partition wall for allowing the belt to pass thereover, towards an outlet.

Other ammunition boxes or magazines with partitions or means for controlling the position or deployment of ammunition are disclosed in U.S. Pat. No. 4,009,638, U.S. Pat. No. 4,610,191, U.S. Pat. No. 4,393,746, U.S. Pat. No. 3,461,774, U.S. Pat. No. 2,874,615, U.S. Pat. No. 4,213,376, U.S. Pat. No. 4,972,258 U.S. Pat. No. 2,452,545, U.S. Pat. No. 6,164,180, U.S. Pat. No. 4,433,609 and U.S. Pat. No. 3,580,131.

By designing ammunition boxes with divider walls and baffles, thereby dividing the ammunition box into several smaller chambers or bays, and then placing a simpler and more robust ammunition retainer device on top of each baffle, the present invention provides a further solution to the problems related to linked ammunition moving from one chamber to another within the ammunition box, thereby reducing ammunition jamming often caused by tilt and vibration of the ammunition box. The siphon effect problem has also been solved.

BRIEF DESCRIPTION OF THE INVENTION

The invention provides an ammunition retainer apparatus for reducing the risk of jamming or wedging of ammunition in an ammunition box or magazine having spaced partitions to subdivide its interior into a plurality of bays, the features of which are recited in the accompanying patent claims 1-6.

Further advantageous features of the ammunition retainer apparatus of the invention are recited in the accompanying patent claims.

The invention provides an ammunition box or magazine comprising the ammunition retainer, the features of which ammunition box or magazine are recited in the accompanying patent claims.

The invention provides a loaded ammunition box or magazine comprising the ammunition retainer, the features of which loaded ammunition box or magazine are recited in the accompanying patent claims.

Further advantageous features of the loaded ammunition box or magazine comprising the ammunition retainer are recited in the accompanying patent claims.

DETAILED DESCRIPTION OF THE INVENTION

Figure 2:
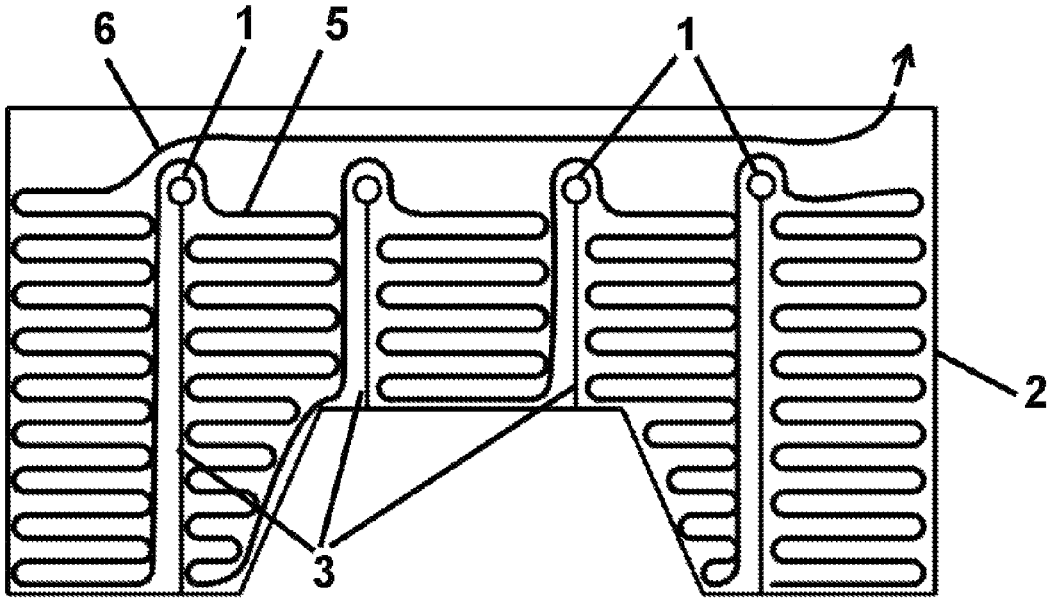
Figure 3:
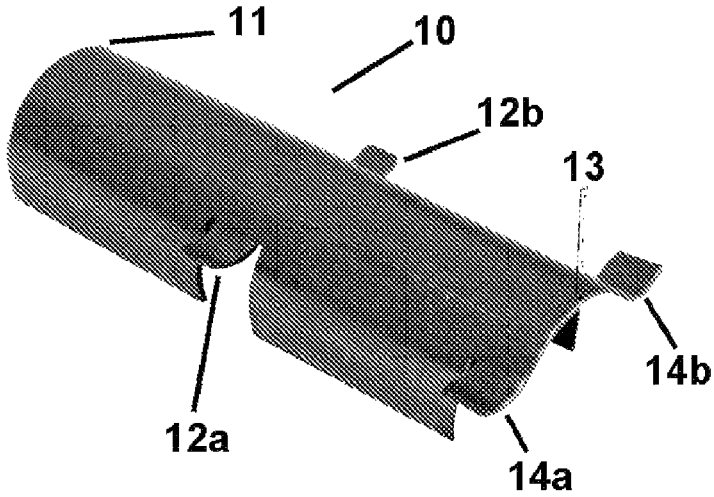
Figure 4:
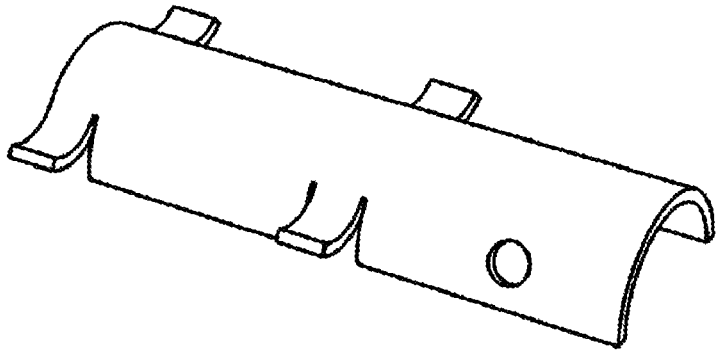
Figure 5:
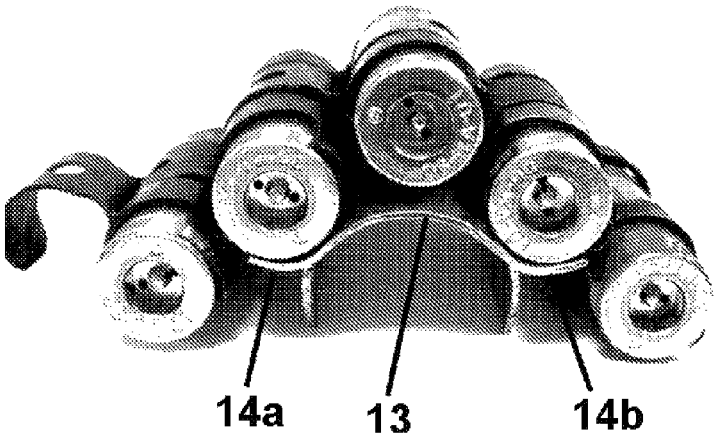
Figure 6:
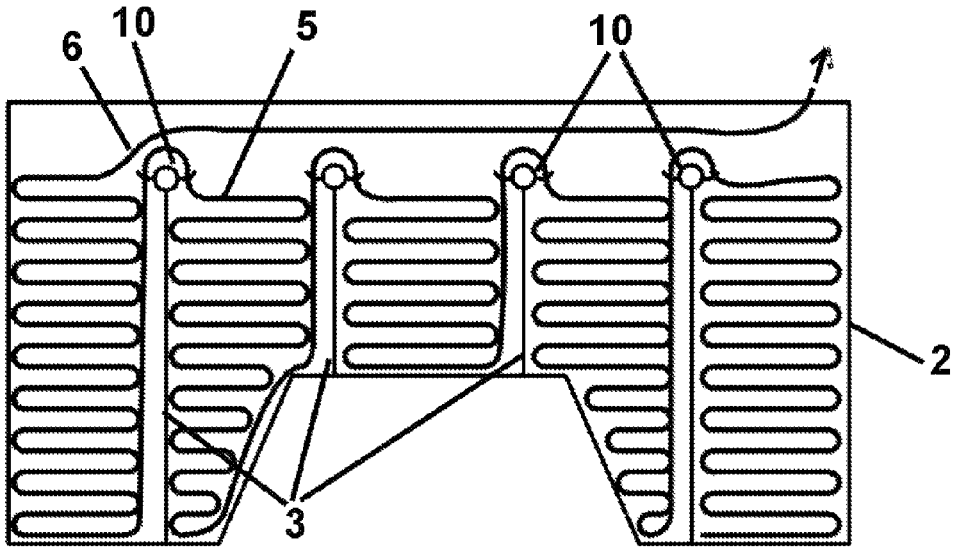
Figure 7:
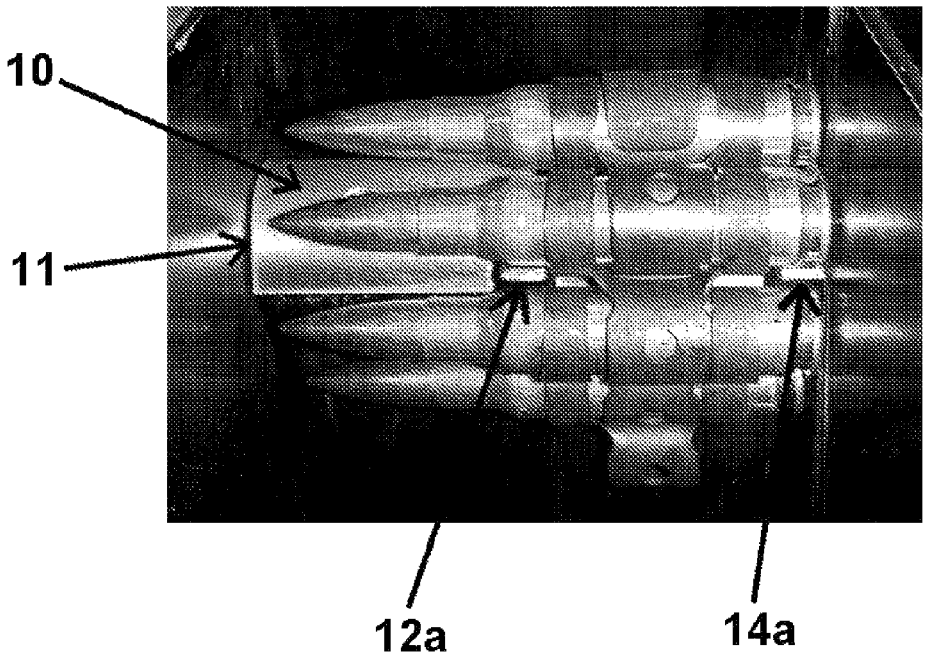
Figure 8:
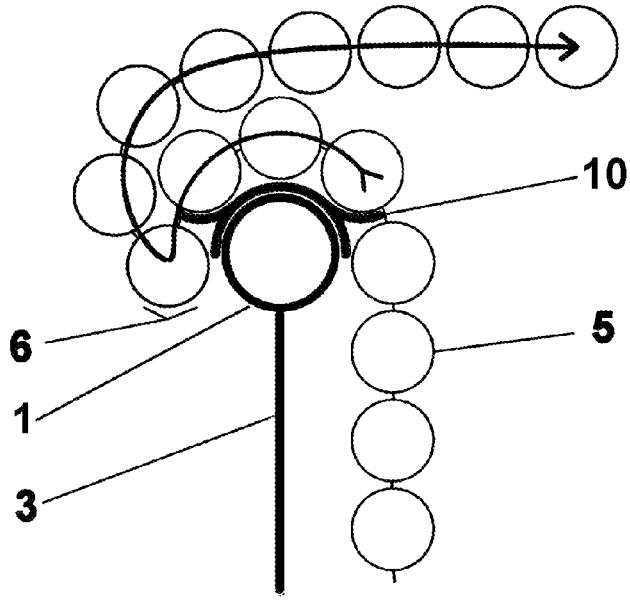
Figure 9:
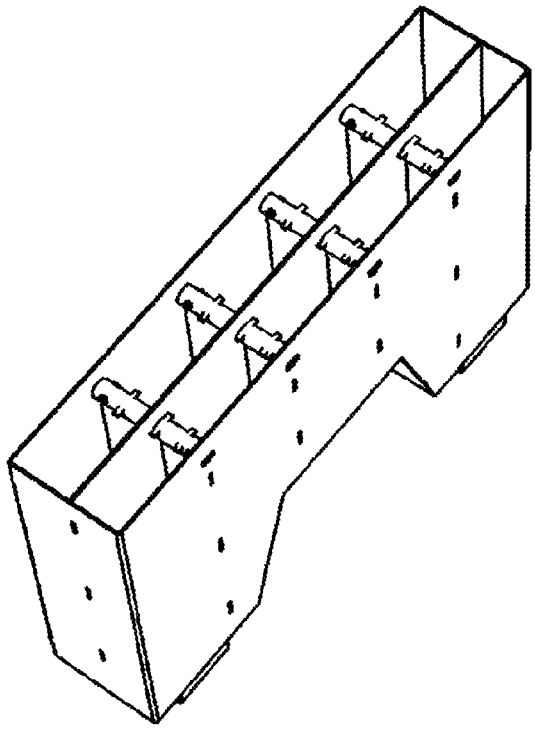
Figure 10:
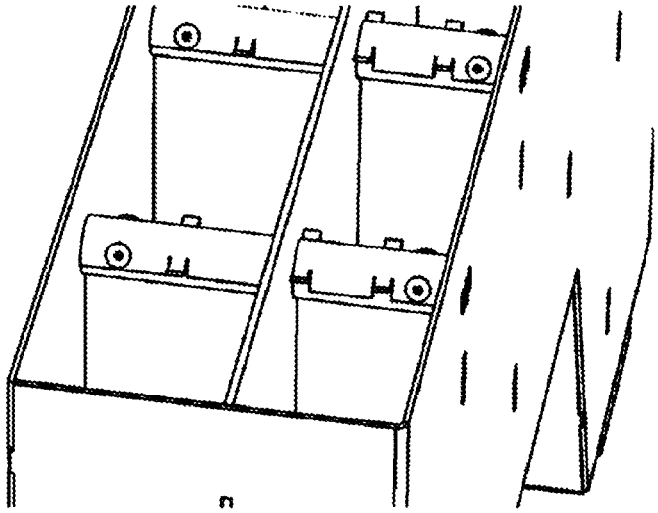
Figure 11:
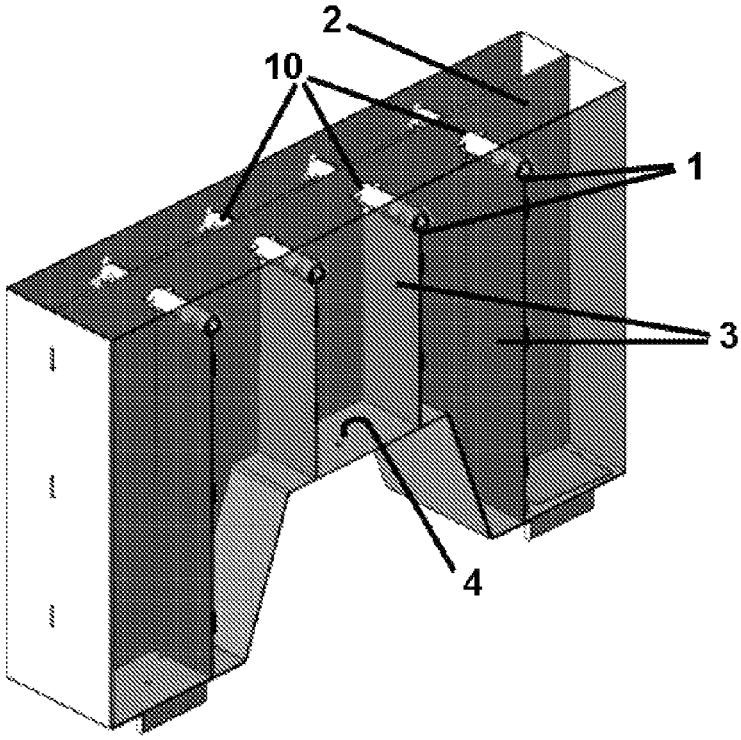
Figure 12:
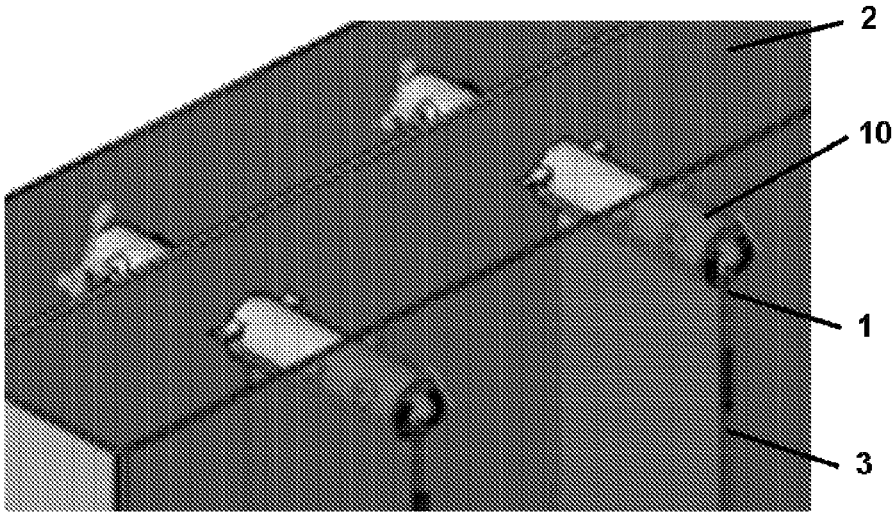

The invention will now be explained in detail, by way of example and with reference to the accompanying drawings, wherein FIG. 1 is a front view illustration of linked ammunition, FIG. 2 is a schematic cross section view illustration of an ammunition box or magazine filled with linked ammunition, FIG. 3 is a first perspective view illustration of an apparatus according to the present invention, FIG. 4 is a second perspective view illustration of the apparatus according to the present invention illustrated in FIG. 2, FIG. 5 is a perspective view of linked ammunition positioned on a retainer bracket according to the invention, FIG. 6 is a schematic cross section view illustration of an exemplary filled ammunition box or magazine comprising the apparatus of the invention illustrated in FIGS. 3 and 4, FIG. 7 is a top view illustration of linked ammunition positioned on a retainer bracket according to the invention in an ammunition box or magazine comprising the apparatus of the invention illustrated in FIGS. 3 and 4, FIG. 8 is a side view schematic detailed illustration of the operation of the apparatus of the invention comprised in the exemplary ammunition box or magazine illustrated in FIG. 4, FIG. 9 is a first perspective view illustration of an exemplary ammunition box or magazine, FIG. 10 is a detailed view of the first perspective view illustration of FIG. 9 of an exemplary ammunition box or magazine, FIG. 11 is a second perspective view illustration of an exemplary ammunition box or magazine, and FIG. 12 is a detailed view of the second perspective view illustration of FIG. 11 of an exemplary ammunition box or magazine, FIG. 1 illustrates front in a view drawing, a short section of linked ammunition, hereinafter referred to as ammunition 6. The ammunition 6 comprises a plurality of cartridges linked together, such as for example by way of a plurality of clips 5. Each clip has first grip part and a wider second grip part. In the second grip part is an opening, adapted to the outer shape of the first grip part. The first grip part is adapted to clip onto and hold a central part of a first cartridge, while the second grip part is adapted to clip onto and hold parts of a corresponding second cartridge located to the sides of the central part. Thus, the central part of the second cartridge is left free for it to be held by a first grip part of a corresponding next clip, to form a belt of linked cartridges.

FIG. 2 is an illustrates in a schematic cross section view a typical well-known ammunition box or magazine filled with linked ammunition 6, the linked ammunition 6 forming a continuous belt located in bays in the ammunition box or magazine container formed by baffles 3. The linked ammunition is available to be pulled out of the container at an exit of the ammunition box or magazine container, illustrated by the arrow on the right hand side of the drawing. For continuity of the belt between bays, the linked ammunition is run over upper edges 1 of the baffles 3. The typical well-known ammunition box or magazine illustrated in FIG. 2 does not include means to restrict or impede movement or sliding of the belt of linked ammunition 6 over the upper edges 1 of the baffles 3.

In FIGS. 3 and 4 is illustrated an advantageous ammunition retainer bracket 10 embodiment of the apparatus of the invention. The retainer bracket 10 comprises an elongated body having first and second ends 11 and 13, respectively. The retainer bracket 10 comprises sets of spaced tabs. The sets of tabs are a first set of central tabs 12*a* and 12*b*, located at a first position between the first and second ends, and a second set of end tabs 14*a* and 14*b*, located at the second end. Central tab 12*a* and end tab 14*a* are located on a first side of the elongated body to constitute a first pair of tabs, and central tab 12*b* and end tab 14*b* are located on a second side of the elongated body to constitute a second pair of tabs. The spacing of the central tabs 12 and the end tabs 14 is adapted so as to allow the second grip part of clips 5 to be accommodated between them, while, as illustrated in part in FIGS. 5 and 7, allowing parts of cartridges located outside the second grip part of clips 5 to rest on the tabs when the belt of linked ammunition 6 is placed over the retainer bracket, and the tabs are dimensioned for extending into a space between adjacent ones of the cartridges forming the belt of linked ammunition 6.

In an advantageous embodiment of the invention, tabs 12*a*, 12*b*, 14*a*, and 14*b* are curved or shaped in conformity with a curvature of a circular cross section of the part of the cartridges of the belt of linked ammunition 6 that the tabs are to provide a rest for. The curved shape, however, could be replaced by other shapes, provided that the shape allows the belt of linked ammunition to be pulled off the upper edge 1 of the baffle 3 of the ammunition box or magazine container, as illustrated schematically in FIG. 8.

FIG. 6 illustrates in a cross section view schematically the ammunition box or magazine container of FIG. 2 provided with retainer brackets 10 according to the invention at the upper edges 1 of the baffles 3, and a belt of linked ammunition filled into the bays between the baffles in the shape of a serpentine, and run over the upper edges 1 to form continuity of the belt as it runs from one bay to the next.

Advantageously, the part of the elongated body of the retainer bracket keeping the first pair of tabs on one side of the spaced from the second pair of tabs, would generally be shaped as a half-pipe, and the tabs extending from the body of the retainer bracket 10 such that the end of the tabs are at a distance of approximately between one half and two thirds of the diameter of the cartridge away from the body. Accordingly, in an embodiment of the invention designed to be employed in an ammunition box or magazine container with baffles adapted for 7.62 mm (0.30 cal) linked ammunition using clips 5 that link the cartridges with spacings of about 3 mm, the diameter of the half-pipe body should be about 18 mm, the first pair of tabs should have a separation from the other pair of tabs of about 38 mm measured on the circumference of the body, the tabs should protrude on respective radii of the half pipe shape to a distance of about 5 mm, the tabs of each pair of tabs should have a separation of about 28 mm, and the tabs should have a cross section of about 2 mm by 6 mm. For other types of linked ammunition, such as for example for 5.56 mm (0.22 cal) linked ammunition, the dimensions of the retainer bracket are scaled accordingly.

In an advantageous embodiment of the invention, the tabs are located on the circumference of the body, and also shaped and dimensioned such that when the belt of linked ammunition is placed onto of, and partly folded around the retainer bracket, a group of three cartridges are accommodated above and between the first and second pairs of tabs, while the tabs are brought into close contact with the next cartridges on either side of the group. The close contact will insure an improved stability of the linked ammunition. In the aforementioned close contact arrangement, one could take advantage of the resilience of the clips 5, to obtain a "soft" locking of the cartridges to the protruding tabs of the retainer bracket of the invention. The illustration of FIG. 7 shows a first pair of tabs 12*a* and 14*a* dimensioned to closely fit the spacing between the cartridges of the belt of linked ammunition, and also spaced from the second pair of tabs 12*b* and 14*b* (not visible) along the circumference of the body, and also angled away from a radius of the body, such that a slight force is applied to the cartridge located below the tab to keep the cartridge in place as shown. The same is illustrated in the schematic side view of FIG. 8, which also illustrates how the linked ammunition would be pulled of the retainer bracket 10 by the pull symbolized by the arrow, in a rolling movement about the adjacent cartridge next to the cartridge located immediately below the tab, as one bay is about to be emptied and ammunition is about to be supplied from the neighbouring bay.

To optimize the performance of the retainer bracket 10 of the invention, filling of an ammunition box or magazine container 2 employing the retainer brackets 10 of the invention at the upper edges of partitions 3 should be as illustrated in FIG. 6, with the belt of linked ammunition 6 filling the bays in a serpentine fashion with start from the bottom of the bay, the uppermost layer of the serpentine ending next to and below the upper edge 1 of the partition 3 to which the retainer bracket is attached, and then to continue over the retainer bracket, along the partition 3 and down to the bottom of the next bay into which the belt of linked ammunition is further disposed to fill that next bay in a serpentine like fashion.

The apparatus of invention can be seen as employed in the exemplary ammunition boxes depicted in FIGS. 9, 10, 11 and 12. The ammunition boxes include at least one section including the ammunition retainer bracket of the invention, adapted for a 7.62 mm (0.30 cal) bullet, such as illustrated initially in FIG. 1, although that caliber is employed in this disclosure for illustration purpose only, as the ammunition retainer of the invention can be adapted for use on different calibers.

The ammunition retainer of the invention stops the linked ammunition from moving from one chamber to another when the ammunition box is exposed to tilt and/or vibration, and also eliminates the siphon effect. This is done by actually locking the linked ammunition belt in place at the top of each baffle with the ammunition retainer of the invention, and still be able to freely pull the linked ammunition out of the ammunition box, as the ammunition retainer of the invention is not hampering the ammunition feeding or flow. The typical ammunition boxes depicted in FIGS. 9, 10, 11 and 12 are particularly well suited for being provided with the ammunition retainer of the invention. In the illustrations of FIGS. 9, 10, 11 and 12, ammunition retainers 10 according to the invention are shown on top of baffles 3, which combined with a further divider wall, shown as the vertical divider wall 2, divides the ammunition box into ten chambers 4, where chambers on one side of the divider wall 2 is reserved for 7.62 mm (0.30 cal) linked ammunition, and chambers on the other side of the divider wall 2 is reserved for 5.56 mm (0.22 cal) linked ammunition. The ammunition retainer according to the invention is present on top of the baffles in both sides of the ammunition box.

There are two significant aspects to consider in respect embodiments of the present invention, although also in respect of the general inventive concept of the present invention. These aspects have to some extent been indicated in the disclosure above, and will now be further elucidated by the following discussion.

A first aspect to be discussed herein, is that the invention is ammunition is linked. The linking member, herein also referred to as the clip 5, that keeps the individual cartridges joined together is designed in such a manner that the cartridges have a little gap between them, as can be seem from the illustrations of FIGS. 1, 5 and 7. This gap is taken into consideration in the design of the ammunition retainer apparatus of the invention. The second aspect to be discussed, is the way in which the ammunition box is to filled or loaded to take further advantage of the stabilizing properties of the ammunition retainer apparatus of the present invention.

In respect of the first aspect, when the ammunition belt is folded over a baffle provided with the ammunition retainer of the invention, it gets locked in place at the top of the baffle. This is accomplished by the design of the inventive ammunition retainer apparatus proposed herein, where four tabs, two on each side, are located such that each of two on the same side will come into place between two adjacent cartridges in the linked ammunition belt. In respect of this first aspect, reference is made to FIGS. 7 and 8, teaching how these tabs are designed such that they fit into the space between two adjacent cartridges, while not interfering with the linking member that joins adjacent cartridges together. In this way, the linked ammunition belt is allowed to rest on the tabs of the ammunition retainer of the invention, regardless of tilt or vibration on the ammunition box, or the siphon effect. The ammunition belt is not allowed to move, and the ammunition will stay in the chamber into which it was originally loaded, until it is pulled out of the box in a normal fashion. Thereby, the apparatus of the invention is eliminating the possibility of ammunition moving from one chamber to another, which is known to causing interlinking and, hence, ammunition jamming.

In respect of the second aspect, to optimize the exploitation of the advantageous effect of employing the ammunition retainer apparatus of the invention in an ammunition box or magazine with internal baffles, the ammunition box should be loaded or filled in a certain way. With regard to this second aspect, particular reference is made to FIG. 6, for an illustration of an example of an advantageous loading pattern. The linked ammunition should to be loaded in such a way that one chamber is filled at a time, then the ammunition belt is folded over the baffle which is provided with an ammunition retainer of the invention on top for "locking" the ammunition belt in place. In the ammunition box fully loaded or filled as illustrated in FIG. 6, the continuation of the belt of linked ammunition is brought back over the ammunition resting of the ammunition retainers on top of the baffles and to an ammunition box exit which should be located over or in the vicinity of the upper part of the first bay, thus allowing the belt to continue to be fed to the weapon. With the ammunition box or magazine container loaded as described herein, when the belt of linked ammunition is pulled out of the container, it is pulled over the underlying layer of ammunition, to eventually roll over the ammunition retainer of the invention when a bay is about to be emptied, thereby staying clear of the tabs. The operation is illustrated in further detail in the schematic side view drawing of FIG. 8, where the "tail" cartridge 6, that is, the last cartridge of the ammunition belt in the bay to the left of the baffle 3, gets lifted away from the tabs on the left hand side of the ammunition retainers 10 taps, to eventually roll over the baffle 3. The rolling movement is achieved by retention of the cartridges to the right hand side of the "tail" cartridge 6 provided by the tabs on the right hand side or the ammunition retainer 10, which tabs provide a rest for the neighbouring cartridges. Thus, the "tail" 6 of the linked ammunition belt will follow the path indicated by the curved arrow line, to be lifted, upwards and to the left, and clear of underlying ammunition as well as clear of the tabs of the ammunition retainer of the invention.

As discussed herein, for optimization of the performance of the ammunition retainer apparatus of the invention, attention should be paid to obtain the best interaction between the ammunition retainer and dimensional characteristics of the belt of linked cartridges, to ensure good "locking" of the belt as it is in place over the ammunition retainer, while balancing the retention force applied to the belt by the ammunition retainer of the invention to the force provided by the weapon or its associated ammunition drive means for pulling the ammunition from the ammunition box or magazine. In particular, the angle at which tabs protrude from the body, the length, width and thickness of the tabs, as well as the shapes of tabs are parameters that may be varied in the optimization of the ammunition retainer of the invention for different types of linked ammunition, different designs of ammunition boxes or magazines, and different types of weapons.

It should be noted, that although the invention has been disclosed herein by way of examples, of which some have proven to be highly advantageous for the specific types of ammunition used to illustrate the invention, the tabs on one side of the elongated body may be shaped differently form the tabs on the other side of the body. Different shaping of the various tabs may be find to be advantageous depending on the way or pattern in which the belt of linked ammunition is loaded in the ammunition box or magazine. As an example, when considering the loading pattern illustrated in FIG. 6, in conjunction with the unloading patterns indicated in FIG. 6 by the line towards the exit and the arrow indicating where and how the belt is pulled from the magazine to unload the ammunition, and the detain of operation depicted in FIG. 8 and explained above, the tabs on the side towards the bay which is first emptied could advantageously be angled, shaped and dimensioned in consideration of the direction in which the belt is running along the divider wall 3 to the bottom of the bay to the left of the wall and the direction of the lifting force applied to the "tail" for "unlocking" the belt form the ammunition retainer. The tabs on the right hand side of the body could be angled, shaped and dimensioned differently from the tabs on the opposite side of the body, as the ammunition belt to the right hand side of the ammunition retainer as illustrated by the example of FIG. 6 could approach the retainer from a different angle, and it should be taken into consideration that the belt of linked ammunition would be pulled more or less straight off the tabs without the rolling movement of the linked ammunition that is seen on the other side of the retainer.

In the illustrations and pictures ammunition with a 7.62 mm (0.30 cal) caliber has been used for illustration purpose, but the Ammunition Retainer can be adapted to most ammunition calibers, link types and ammunition boxes where found suitable.

The ammunition retainer of the invention could be provided as a plurality of member, to be assembled to form the ammunition retainer disclosed herein. However, in an advantageous embodiment of the present invention, the ammunition retainer of the invention is produced as a single, unitary member, in that it may be cost effectively stamped from a sheet of metal, and even shaped during the stamping operation, or cast or molded in a single piece, thus requiring no further machining or other operation for it to be ready to be applied to or mounted on the ammunition box or magazine or to other element forming part of the ammunition box or magazine. The inventive ammunition retainer disclosed herein by way of example in the form of a separate bracket unit 10 to be mounted on the ammunition box or magazine or a part of an ammunition box or magazine is considered an advantageous embodiment in particular for applications for retrofitting existing designs of ammunition boxes or magazines, although the ammunition retainer of the invention is capable of being provided as an integral part of the ammunition box or magazine, or as an integral part of a baffle or other means of the ammunition box or magazine, such as means for providing the chambers or bays into which the linked ammunition could be loaded for loading of the ammunition container.

In an embodiment of the ammunition retainer of the invention, in case the ammunition retainer is adapted for retaining a plurality of cartridges between the first and second pairs of tabs, additional tabs are provided, such as for example a third set of tabs protruding from the body and located at a position along the circumference of the body between the first and second pairs of tabs. Conversely, in case the ammunition retainer is adapted for retaining one cartridge between the first and second pairs of tabs, further tabs may be arranged to at least one side of the first or second pairs of tabs.

In yet a further advantageous embodiment of the ammunition retainer apparatus of the invention, the tabs of a pair of tabs are positioned along the longitudinal direction of the elongated body so as to maintain cartridges "locked" in place by the ammunition retainer with the percussion cap proximal to a first side wall of the linked ammunition container, while maintaining a space between the pointed bullet end of the ammunition and a second side wall of the ammunition container located opposite to the first side wall of the ammunition container. Maintaining the "locked" ammunition in place by positioning the tabs as indicated herein, is effectively achieved by positioning the tabs as illustrated in FIG. 7, wherein the elongated body is fittable across the interior of the container in which the first and second side walls are separated by a distance that exceeds that overall length of the ammunition unit as measured from the percussion cap end to the bullet tip by about ten percent or more, thus allowing some free space between the bullet tip and its adjacent second container side wall, the end tab 14*a* to "lock" the cartridge at the percussion cap end is positioned at the end of the body to be located proximal to the first container side wall, and the corresponding central tab 12*a* is positioned to have a side facing the end tab 14*a* located at the position of the "upper edge" of the clip 5 when the cartridge is in place on the ammunition retainer with the percussion cap immediately next to the second container side wall.

It should be noted that in an embodiment wherein the elongated body is shortened while the positions of the tabs are maintained, also the central tabs 12*a*, 12*b* could be termed "end tabs" 12*a*, 12*b*, as being located at a different end of the body, opposite to the end at which the end tabs 14*a*, 14*b* are located.

The tabs of the ammunition retainer of the invention may be provided resilience as suitable for maintaining the linked ammunition "locked" in position at the ammunition retainer, such as for example by use of a material having inherent resilient properties for the tab itself, or by attaching the tab to the body of the ammunition retainer by a section of resilient material. Optionally, one or more tabs may be shaped to provide resilience for advantageously locking the belt to the tab by way of the gap between adjacent ones of two cartridges of the belt of linked ammunition cartridges, such as for example by making the tab longer than shown in the accompanying drawings and then folding back an outer part of the tab to a shape and dimension that will allow it to be fit by some force into the gap between adjacent cartridges and in that position exerting by spring action of the folded back portion counteracting forces on both cartridges to increase friction for holding the cartridges "locked" to the tab, also in case of a belt of linked ammunition cartridges with considerable variations of dimensions of the gaps between cartridges.

The invention disclosed herein may be performed in a first method of providing an ammunition box or magazine with the functionality of the ammunition retainer disclosed above, in a second method of loading an ammunition box or magazine having the ammunition retainer disclosed above with a belt of linked ammunition starting from the bottom of a first bay via and over the ammunition retainer apparatus and on to a next bay adjacent to the first bay including loading the first and bays with linked ammunition in a serpentine like pattern and on to an exit of the box or magazine, or in a third method for unloading linked ammunition from a loaded magazine wherein ammunition is obtained by pulling linked ammunition from the loaded box or magazine via a path corresponding to the one taught by the illustrating arrow and its associated line in FIG. 6 and over the inventive ammunition retainer as taught by the illustration of FIG. 8 as the next bay is being emptied and ammunition then is supplied from the first bay.

The invention claimed is:

1. An ammunition box or magazine having divider walls dividing the interior of the box or magazine into bays for storing a continuous belt of linked ammunition cartridges starting in a first bay and running over a top of a divider wall and into a second bay adjacent to the first bay; and an ammunition retainer bracket apparatus, said ammunition retainer bracket apparatus preventing the belt of linked ammunition cartridges loaded into the bays of the ammunition box or magazine from being siphoned by the belt itself between the first and second adjacently located bays, the ammunition retainer bracket apparatus comprising an elongated body having a) on a first side, a first pair of tabs rigidly attached to the body and protruding from the body in a first direction, and b) on a second side, a second pair of tabs rigidly attached to the body and protruding from the body in a second direction, wherein the elongated body is affixed at the top of the divider wall of said first and second bays thereby positioning said first pair of tabs in or immediately above said first bay and said second pair of tabs in or immediately above said second bay, and the apparatus prevents the belt loaded into the bays of the ammunition box or magazine equipped with said retainer bracket apparatus, from being siphoned by the belt itself between said first and second adjacently located ones of said bays.

2. A loaded ammunition box or magazine having a divider wall dividing an interior of the box or magazine into bays and a continuous first belt of linked ammunition cartridges starting in a first bay and running over a top of the divider wall and into a next bay adjacent to the first bay, wherein the box or magazine includes an ammunition retainer bracket apparatus arranged at the top of the divider wall, said an ammunition retainer bracket apparatus, affixed on the top of the divider wall dividing the interior space of the ammunition box or magazine into first and second adjacently located bays to carry a part of a first belt of linked ammunition cartridges loaded into said first and second bays and continuously over said divider wall, for preventing said first belt of linked ammunition from being siphoned by the first belt itself between said first and second adjacently located bays, the ammunition retainer bracket apparatus comprising:

an elongated body having a) on a first side, a first pair of tabs rigidly attached to the body and protruding from the body in a first direction, and b) on a second side, a second pair of tabs rigidly attached to the body and protruding from the body in a second direction, said ammunition retainer bracket apparatus being affixable on the top of said divider wall dividing the interior space of the ammunition box or magazine into the first and second adjacently located bays to carry the part of the first belt of linked ammunition cartridges loaded into said first and second bays and continuously over said divider wall, preventing said first belt of linked ammunition from being siphoned by the first belt itself between said first and second adjacently located bays, and wherein the elongated body of the retainer bracket apparatus is arranged to be affixed at the top of the divider wall of said first and second bays so as to position said first pair of tabs in or immediately above said first bay and said second pair of tabs in or immediately above said second bay, and so as to prevent the first belt of the linked ammunition loaded into and being continuous between the first and second adjacently located bays of the ammunition box or magazine equipped with said retainer bracket apparatus, from being siphoned by the first belt itself between said first and second adjacently located bays.

3. The loaded ammunition box or magazine of claim 2, the ammunition box or magazine having an exit located immediately above the first bay or above and to a side of the first bay located away from the next bay, and wherein the first belt of linked ammunition is deposited in the first bay in a serpentine like pattern and runs in continuity from the top of the first bay and over the ammunition retainer bracket apparatus and into the bottom of the next bay along the divider wall and in continuity from the bottom of the next bay is deposited in a serpentine like pattern from the bottom of the next bay to the top of the next bay and runs in continuity from the top of the next bay to the exit.

4. The loaded ammunition box or magazine of claim 2, wherein at least one tab of the ammunition retainer is force fitted in a gap between any two adjacent ones of cartridges constituting the continuous first belt of linked ammunition cartridges.

5. The loaded ammunition box or magazine of claim 2, wherein a plurality of cartridges of the first belt of linked ammunition cartridges are fit and locked onto the ammunition retainer between the first and second pairs of tabs by a) a first force exerted by the first pair of tabs on a first cartridge located to a first side of the plurality of cartridges, the first force having a component directed towards the bottom of the first bay, and b) a second force exerted by the second pair of tabs on a first cartridge located to a second side of the plurality of cartridges, the second force having a component directed towards the bottom of the second bay.

6. The loaded ammunition box or magazine of claim 5, wherein the first force or second force is provided by resilience of a tab or by resilience of a linking member of the first belt of linked ammunition cartridges.

* * * * *